US005575361A

United States Patent [19]

Chou

[11] Patent Number: 5,575,361

[45] Date of Patent: Nov. 19, 1996

[54] WHEELED SUITCASE

[76] Inventor: Ming-Shi Chou, No. 59, Hsi-Chou Rd., 439 Ta-An Hsiang, Taichung Hsien, Taiwan

[21] Appl. No.: 383,945

[22] Filed: Feb. 6, 1995

[51] Int. Cl.[6] ..... A45C 5/14; A45C 13/26

[52] U.S. Cl. ..... 190/18 A; 190/39; 190/115; 16/18 R; 280/37

[58] Field of Search ..... 190/18 A, 115, 190/126; 16/18 R; 280/37, 655, 655.1, 473.15, 47, 371

[56] References Cited

U.S. PATENT DOCUMENTS

| | | | |
|---|---|---|---|
| 3,948,365 | 4/1976 | Gregg et al. | 190/18 A |
| 4,195,676 | 4/1980 | Walker | 190/18 A X |
| 4,335,896 | 6/1982 | Koffler et al. | 190/18 A X |
| 4,827,564 | 5/1989 | Brown | 16/18 R |
| 4,995,487 | 2/1991 | Plath | 190/115 X |
| 5,083,645 | 1/1992 | Lee | 190/126 X |
| 5,163,539 | 11/1992 | Yang | 190/18 A |
| 5,167,306 | 12/1992 | Carrigan, Jr. | 190/115 X |
| 5,291,976 | 3/1994 | Ku | 190/18 A |
| 5,323,886 | 6/1994 | Chen | 190/18 A |
| 5,393,079 | 2/1995 | Wang | 190/18 A X |
| 5,460,393 | 10/1995 | Tsai | 280/655 |
| 5,469,602 | 11/1995 | Lin | 16/115 |

*Primary Examiner*—Sue A. Weaver

[57] ABSTRACT

A suitcase includes a rectangular suitcase body with a vertical side wall and a horizontal bottom wall, two roller assemblies disposed on the suitcase body and located at a corner between the side and bottom walls of the suitcase body, and a handle assembly disposed on the suitable body. Each of the roller assemblies includes a roller seat mechanism fixed on the suitcase body and has a shaft hole unit formed through the roller seat mechanism, a rotating shaft that extends through the shaft hole unit of the roller seat mechanism, and a roller sleeved rotatably on the rotating shaft. The suitcase body further includes a flexible long wire positioned on a peripheral portion of the vertical side wall of the suitcase body and has two end portions located between the bottom and side walls of the suitcase body, and a horizontal short wire positioned between the bottom and side walls of the suitcase body and between the two end portions of the long wire in alignment with the rotating shafts. The rotating shaft has two ends which respectively abut against an end of the short wire and an end of the long wire so as to prevent the movement of the rotating shafts on the suitcase body.

3 Claims, 8 Drawing Sheets

WHEELED SUITCASE

BACKGROUND OF THE INVENTION

1. Field of the Invention

The invention relates to a suitcase, more particularly to a wheeled suitcase which has two roller-assemblies and a handle assembly that are easy to assemble.

2. Description of the Related Art

FIG. 1 shows a conventional wheeled suitcase according to U. S. Pat. No. 4,995,487 which includes a generally rectangular suitcase body 10 with a vertical side wall 102, a horizontal bottom wall 101 and a horizontal top wall 103, two roller assemblies 17 disposed on the suitcase body 10 and located at a corner between the bottom and side walls 101, 102 of the suitcase body 10, and a handle assembly 20 disposed on the suitcase body 10.

Referring to FIG. 2, an L-shaped support plate 12 is attached to the interior surface of the suitcase body 10 by conventional means in such a manner that the vertical plate section 122 of the support plate 12 is riveted to the vertical side wall 102 of the suitcase body 10 while the horizontal plate section 121 of the support plate 12 is riveted to the horizontal bottom wall 101 of the suitcase body 10. The support plate 12 is provided with two mounting holes 13 and two pairs of inner and outer retaining tab means 14, 15. The inner retaining tab means 14 have shaft retaining apertures 141. Each of the roller assemblies 17 includes a roller seat mechanism 171 fixed on the suitcase body 10 (see FIG. 1) and has a shaft hole unit 172, a rotating shaft 16 which extends through the shaft hole unit 172 of the roller seat mechanism 171 and the apertures 141 of the inner retaining tab means 14, and a roller 11 sleeved rotatably On the rotating shaft 16. Each of the outer retaining tab means 15 are bent upwardly so as to confine one end of the rotating shafts 16 therebetween, thereby preventing the ends of the rotating shaft 16 from axial movement.

Referring to FIGS. 2 and 3(A), the handle assembly includes two parallel vertical outer tubes 21 which have lower end portions riveted securely to the vertical plate section 122 of the support plate 12 in the suitcase body 10, and an inverted U-shaped inner tube 22 that has two vertical sections 221 mounted telescopically within the upper end portions of the outer tubes 21. Each of the upper end portions of the outer tubes 21 is pressed to form a pair of diametrically opposed retaining sheets 211 (see FIG. 3(B)). The suitcase body 10 (see FIG. 1) further includes two lock units, each of which has a tubular bushing 23 with a vertical cylindrical body 231 extending through one of the openings of the top wall 103 of the suitcase body 10 between a corresponding one of the outer tubes 21 and a corresponding one of the vertical sections 221 of the inner tubes 22 and retained on the top wall 103 of suitcase body 10 by confining the top wall 103 of the suitcase body 10 between the outward flange 233 and a retaining ring 26 which is engaged within an annular groove of the cylindrical body 231. A washer 25 is interposed between the retaining ring 26 and the top wall 103 of the suitcase body 10. The lower portions of the opposed retaining sheets 211 of the outer tubes 21 are respectively pressed into two opposed constricted recesses 232 of the corresponding vertical cylindrical body 231, thereby retaining the upper portions of the outer tubes 21 on the top wall 103 of the suitcase body 10.

In the conventional wheeled suitcase, the L-shaped support plate 12 needs to be pressed in advance in order to form the outer retaining tab means 15 which are bent upwardly so that two ends of the rotating shaft 16 can be confined between two outer retaining tab means 15. In this manner, a plurality of complicated procedures, like pressing the upper end portions of the outer tubes 21 to form the diametrically opposed retaining sheets 211 and subsequently pressing the latter into the recesses 232 of the bushing 23, are required to mount the outer tubes 21 of the handle assembly 22 and the bushing 23 to the suitcase body 10. As a result, the process for mounting the roller assemblies and the handle assembly to the conventional suitcase is time-consuming and labor consuming.

SUMMARY OF THE INVENTION

The main object of the present invention is to provide a wheeled suitcase with roller assemblies and a handle assembly that are able to be easily assembled together.

Accordingly, the suitcase of the present invention includes a generally rectangular suitcase body with a vertical side wall, a horizontal top wall and a horizontal bottom wall, two roller assemblies disposed on the suitcase body and located at a corner between the side and bottom walls of the suitcase body, and a handle assembly disposed on the suitcase body. Each of the roller assemblies includes a roller seat mechanism fixed on the suitcase body and has a shaft hole unit formed through the mechanism, a rotating shaft which extends through the shaft hole unit of the roller seat mechanism, and a roller sleeved rotatably on the rotating shaft. The suitcase body further includes a flexible long wire positioned on a peripheral portion of the vertical side wall of the suitcase body and has two end portions located between the bottom and side walls of the suitcase body, and a horizontal short wire positioned between the bottom and side walls of the suitcase body and between the two end portions of the long string in alignment with the rotating shafts. Each of the rotating shafts has two ends which respectively abut against an end of the short string and an end of the long string so as to prevent the rotating shafts from axial movement on the suitcase body. Therefore, the suitcase body of the present invention does not require the L-shaped support plate as the conventional suitcase body does in order to prevent the rotating shafts from axial movement on the suitcase body.

Each of the roller seat mechanisms includes a vertical positioning tube. The handle assembly includes two parallel vertical outer tubes respectively sleeved on a corresponding one of the positioning tubes, and an inverted U-shaped inner tube that has two vertical sections mounted telescopically within the upper end portions of the outer tubes. The suitcase further includes two lock units each of which has a tubular bushing with a vertical cylindrical body extending through one of the openings of the top wall of the suitcase body between a corresponding one of the outer tubes and a corresponding one of the vertical sections of the inner tube, a protrusion extending from the outer surface of the cylindrical body to engage a notch of a corresponding one of the outer tubes, two holes formed through the wall of the cylindrical body in alignment with the holes of a corresponding one of the outer tubes, and a flange extending radially and outwardly from the upper end of the cylindrical body and resting on the top surface of the horizontal top wall of the suitcase body. Each of the locking units further has a resilient snap retainer with a vertical clamping wall embracing a corresponding one of the outer tubes, two aligned horizontal tongues engaged within the holes of a corresponding one of the outer tubes and within the holes of a corresponding one of the bushings so as to retain the outer tubes on the suitcase body, and a C-shaped flange extending outwardly from the upper end of the clamping wall to abut against the bottom surface of the top wall of the suitcase body.

Thus, the upper end portions of the outer tubes employed in the handle assembly of the present invention require not to be pressed to form retaining sheets as the outer tubes of the conventional suitcase. This reduces the manufacturing steps and thus the production expense.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 4A:
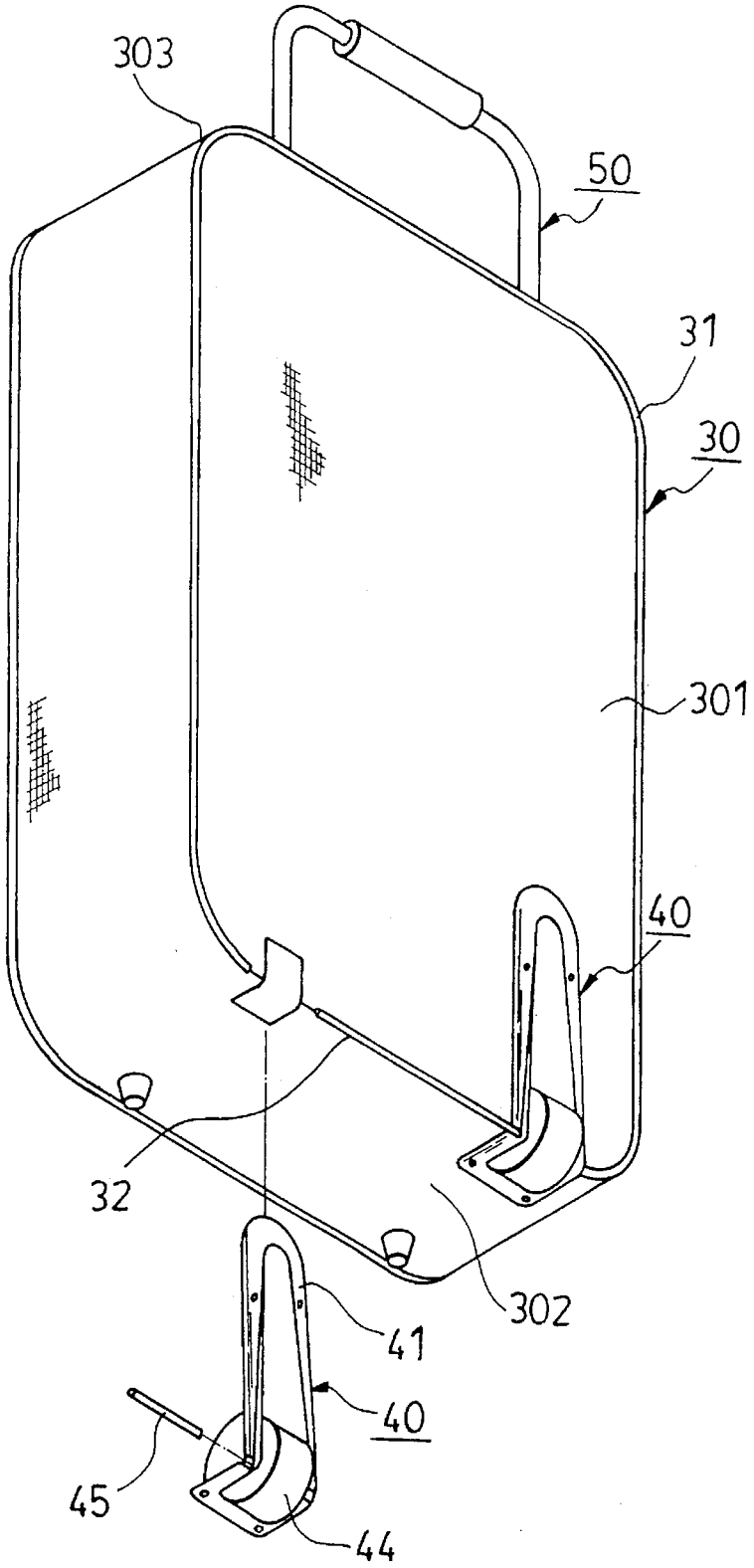
FIG. 4(A) is a perspective view of a wheeled suitcase of the present invention.
Figure 4B:
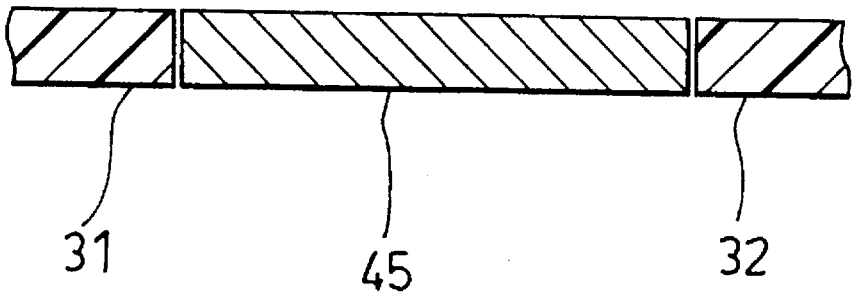
FIG. 4(B) illustrates how a rotating shaft is prevented from the movement in the wheeled suitcase of the present invention.
Figure 5:
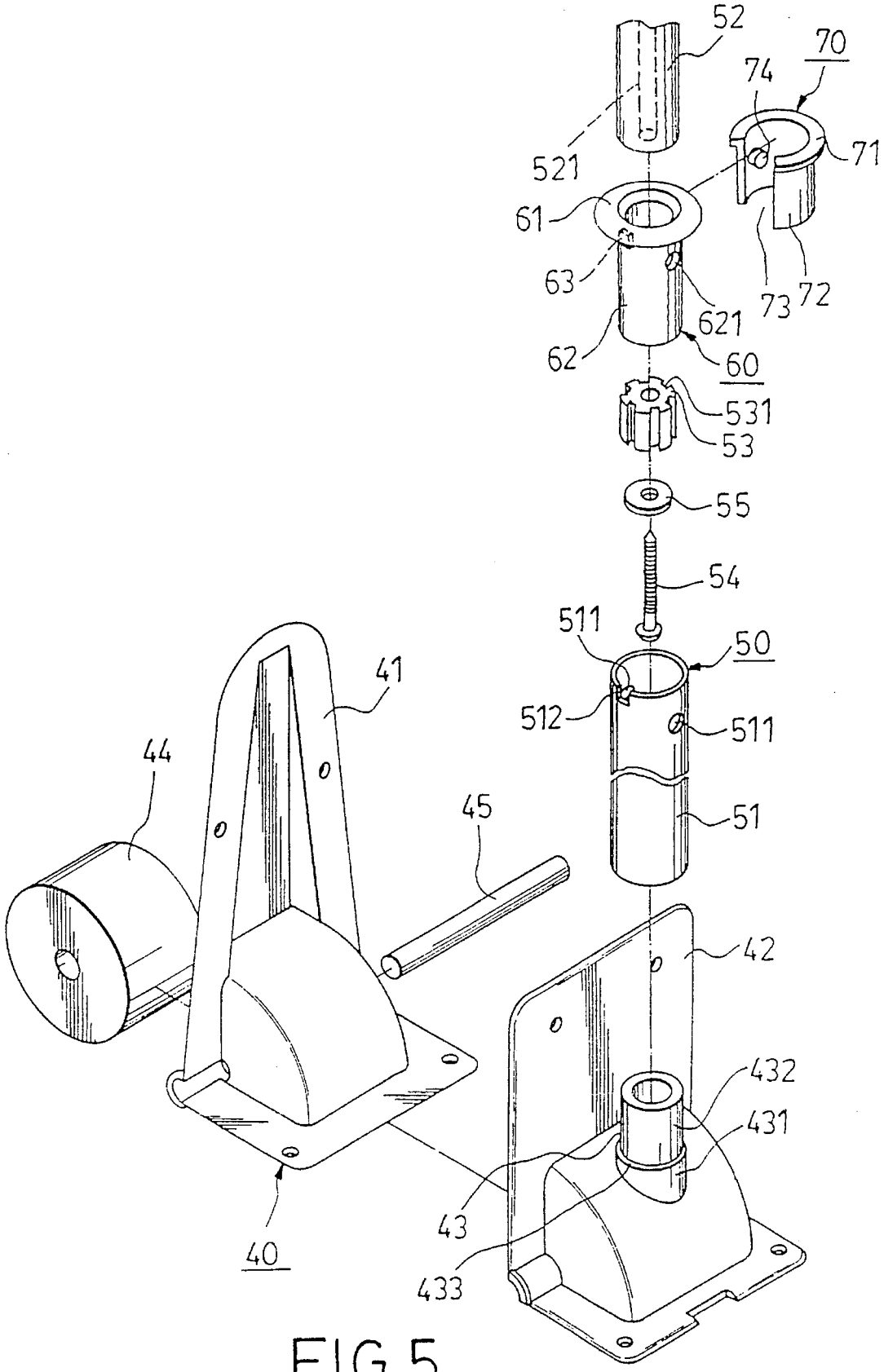
FIG. 5 is a perspective exploded view illustrating how a roller assembly and a handle assembly are coupled together in a suitcase body in accordance with the present invention.

Referring to FIGS. 4(A), 4(B) and 5, a suitcase according to the present invention includes a generally rectangular suitcase body 30 with a vertical side wall 301, a horizontal bottom wall 302 and a horizontal top wall 303 with two circular openings formed therethrough, two roller assemblies 40 disposed on the suitcase body 30 and located at a corner between the side and bottom walls 301, 302 of the suitcase body 30, and a handle assembly 50 disposed on the suitcase body 30.

Each of the roller assemblies 40 includes a roller seat mechanism, which is constituted by L-shaped outer and inner seats 41, 42, fixed on the suitcase body 30 and which has a shaft hole unit formed therethrough, a rotating shaft 45 which extends through the shaft hole unit of the roller seat mechanism, and a roller 44 sleeved rotatably on the rotating shaft 45. The suitcase body 30 further includes a generally U-shaped flexible long wire 31 and a horizontal short wire 32 which are positioned on the periphery of the vertical side wall 301 of the suitcase body 30 to strengthen the rigidity of the suitcase body 30. The long wire 31 has two end portions located between the bottom and side walls 301, 302 of the suitcase body 30. The horizontal short wire 32 is positioned between the bottom and side walls 301, 302 of the suitcase body 30 and between the two end portions of the long wire 31 in alignment with the rotating shafts 45 of the roller assemblies 40. Thus, two ends of the rotating shaft 45 respectively abut against an end of the short wire 32 and an end of the long wire 31 so as to prevent the rotating shafts 45 from the movement on the suitcase body 30.

The L-shaped inner seat 42 of each of the roller assemblies 40 includes a vertical positioning tube 43 formed integrally therewith which has a small-diameter upper portion 432 and a large-diameter lower portion 431 that has an outer diameter larger than that of the small-diameter upper portion 432. Thus, a shoulder 433 is defined between the small-diameter upper portion 432 and the large-diameter lower portion 431. The handle assembly 50 includes two parallel vertical outer tubes 51 sleeved on the small-diameter upper portions 432 of the positioning tubes 43, and an inverted U-shaped inner tube that has two vertical sections 52 mounted respectively and telescopically within the upper end portions of the outer tubes 51. The outer tubes 51 have an inner diameter smaller than outer diameter of the large-diameter lower portions 431 of the positioning tubes 43 such that the outer tubes 51 can rest on the shoulders 433 of the positioning tubes 43. Each of the upper end portions of the outer tubes 51 has two diametrically opposed holes 511 formed through a wall thereof and a positioning notch 512 formed in the upper end of the outer tube 51, the purpose of which will be explained latter.

Figure 6:
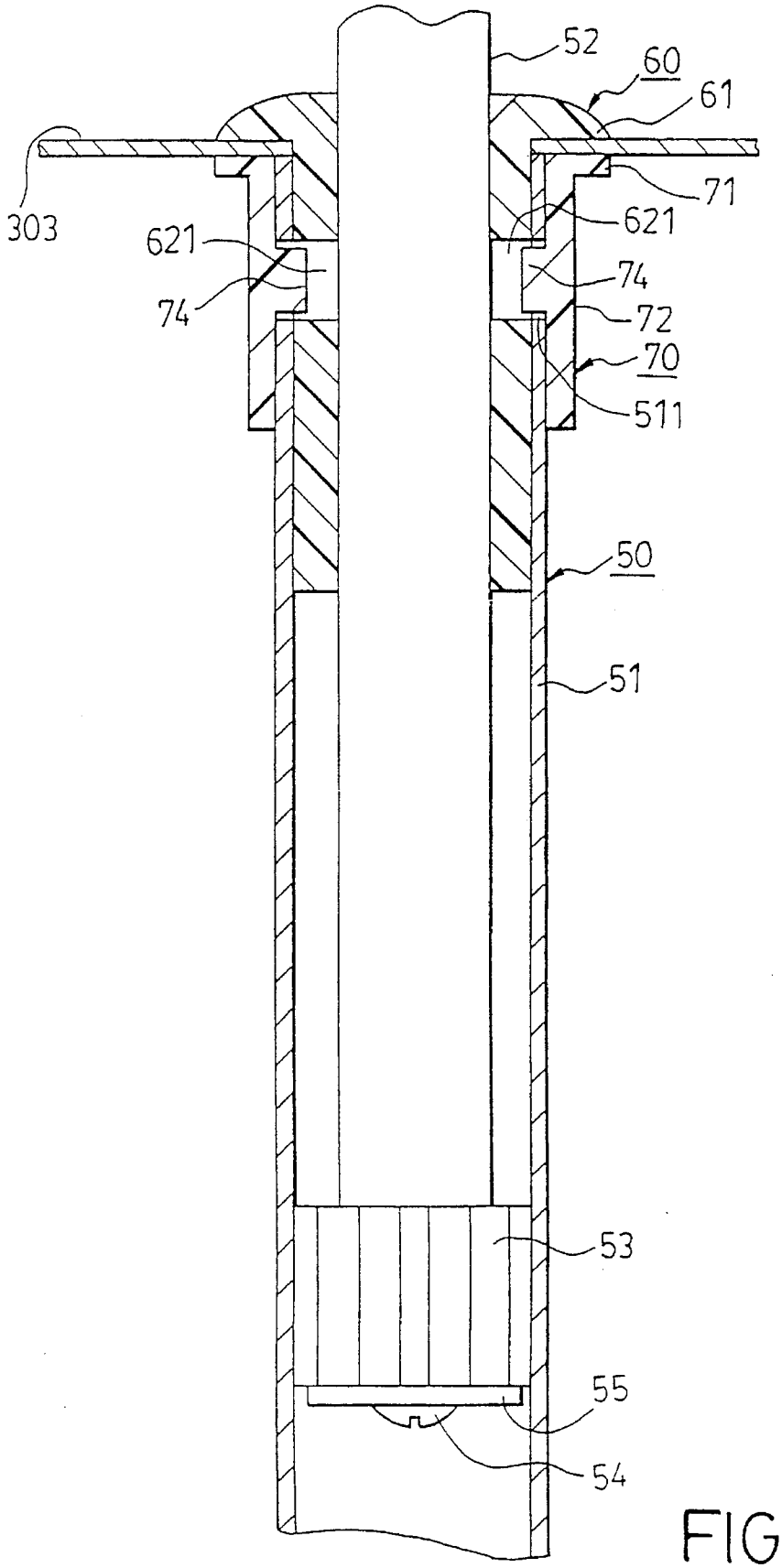
FIG. 6 is a sectional view showing the outer tube of the handle assembly and illustrating how the outer tube is fixed to the suitcase body.

The suitcase further includes two lock units each of which has a tubular bushing 60 and a snap retainer 70. As shown in FIGS. 6 and 7, each of the tubular bushings 60 has a vertical cylindrical body 62 that extends through one of the openings of the top wall 303 (see FIG. 4(A)) of the suitcase body 30 between a corresponding one of the outer tubes 51 and a corresponding one of the vertical sections 52 of the inner tube, a protrusion 63 that extends from the outer surface of the cylindrical body 62 and that engages a corresponding one of the notches 512 of the outer tubes 51, two holes 621 formed through a wall of the cylindrical body 62 in alignment with the holes 511 of a corresponding one of the outer tubes 51, and a flange 61 that extends radially and outwardly from the upper end of the cylindrical body 62 and that rests on the top surface of the horizontal top wall 303 of the suitcase body 30. Thus, the bushings 60 are prevented from downward movement on the suitcase body 30.

Each of the snap retainers 70 is made of a resilient material and includes a vertical clamping wall 72 of a generally C-shaped cross-section which embraces a corresponding one of the outer tubes 51 and which is provided with two aligned horizontal tongues 74 (only one is shown in FIG. 5) that extend inwardly from the inner surface of the clamping wall 72 and that insert within the holes 511 of a corresponding one of the outer tubes 51 and within the holes 621 of a corresponding one of the bushings 60, and a C-shaped flange 71 which extends outwardly from the upper end of the clamping wall 72 and which abuts against the bottom surface of the top wall 303 of the suitcase body 30, thereby locking the upper end portions of the outer tubes 51 to the top wall 303 of the suitcase body 30.

Referring to FIG. 6, the handle assembly 50 further includes two resilient positioning pieces 53 which are connected respectively and threadedly to threaded holes 521 formed in the lower ends of the vertical sections 52 of the U-shaped inner tube by the use of locking screws 54 and washers 55. Each of the positioning pieces 53 is made of a rubber material and has an outer peripheral surface which contacts frictionally the inner surface of a corresponding one of the outer tubes 51. The outer peripheral surface of each of the peripherally toothed positioning rings 53 is formed with a plurality of evenly distributed axial grooves 531 which extend along the total length thereof so as to effectively position the vertical sections 52 of the inner tubes within the outer tubes 51.

Figure 1:
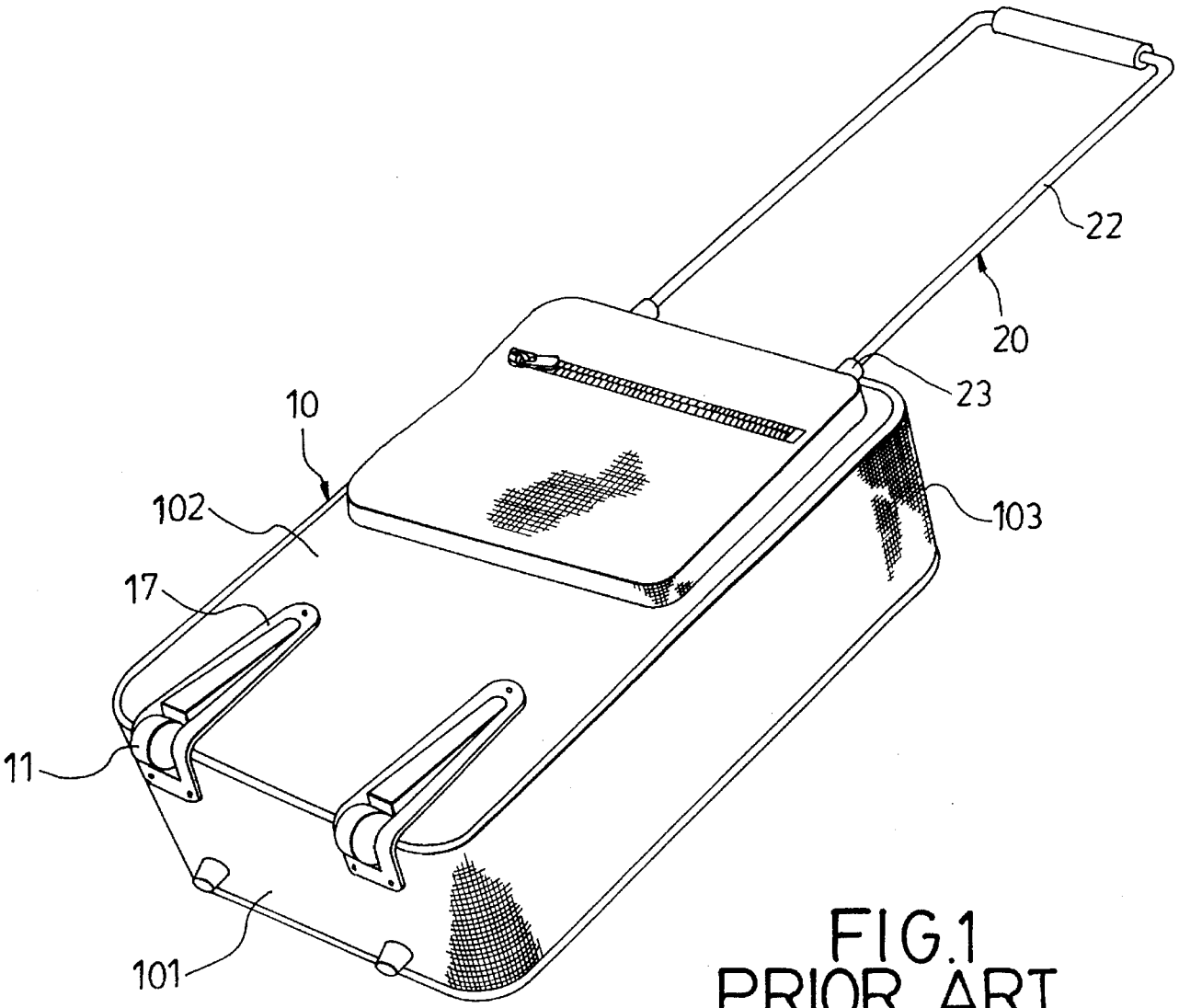
FIG.1 PRIOR ART
FIG. 1 is a perspective view of a conventional wheeled suitcase disclosed by U. S. Pat. No. 4,995,487.
Figure 2:
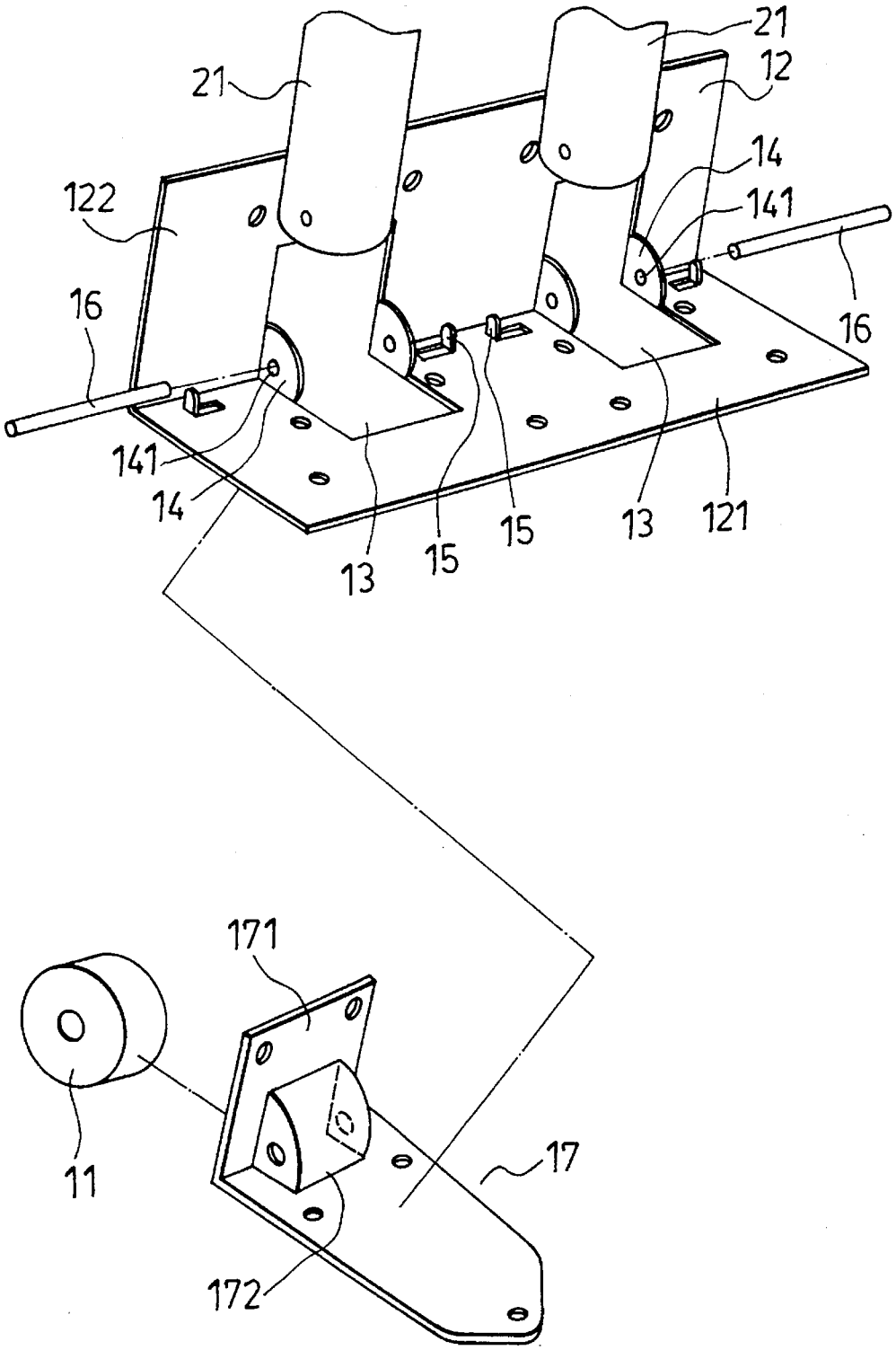
FIG.2 PRIOR ART
FIG. 2 is a perspective exploded view showing an L-shaped support plate fixed in the conventional suitcase of FIG. 1 for mounting a pair of roller assemblies and a pair of outer tubes of the handle assembly.
Figure 3A:
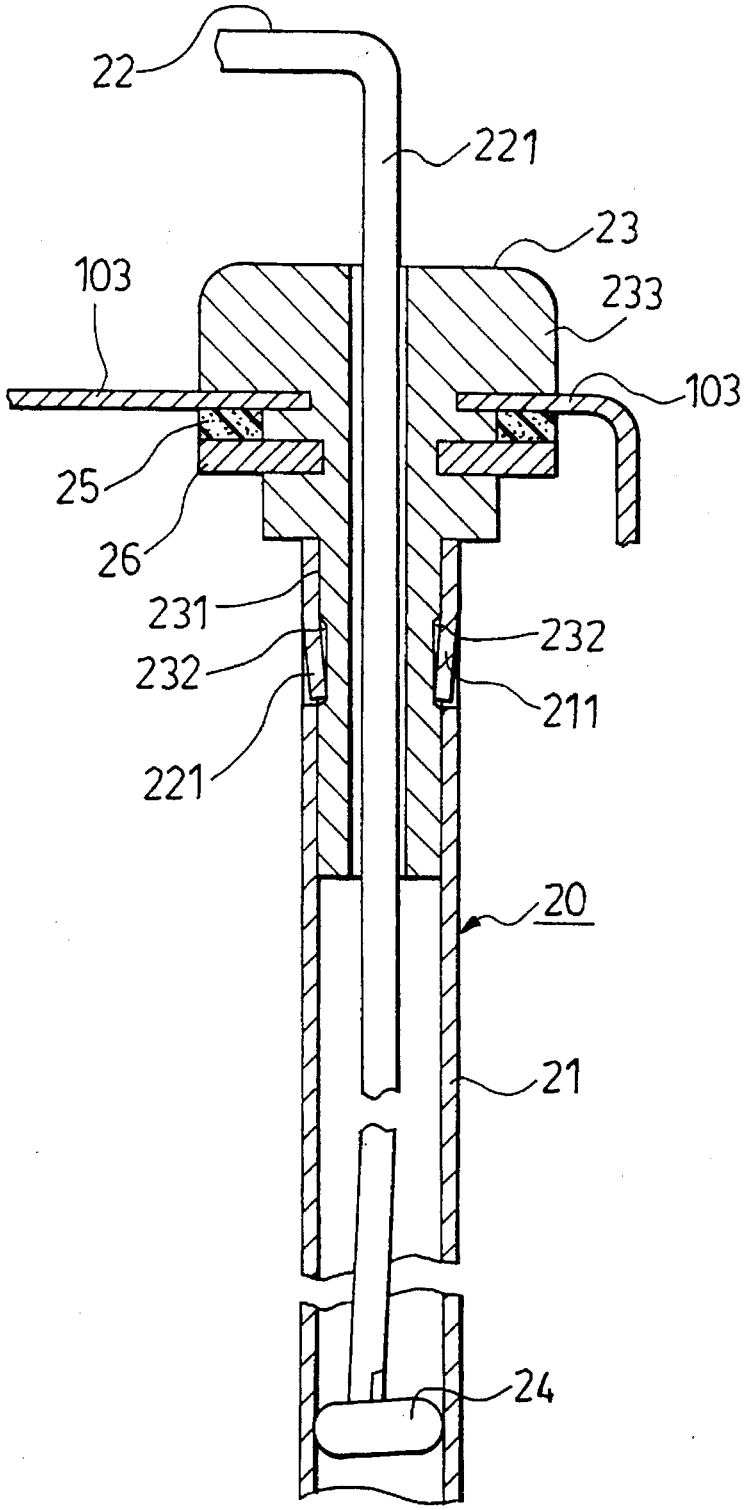
FIG.3(A) PRIOR ART
FIGS. 3(A) and 3(B) illustrate how the outer tubes of the handle assembly of the conventional suitcase are mounted.
Figure 3B:
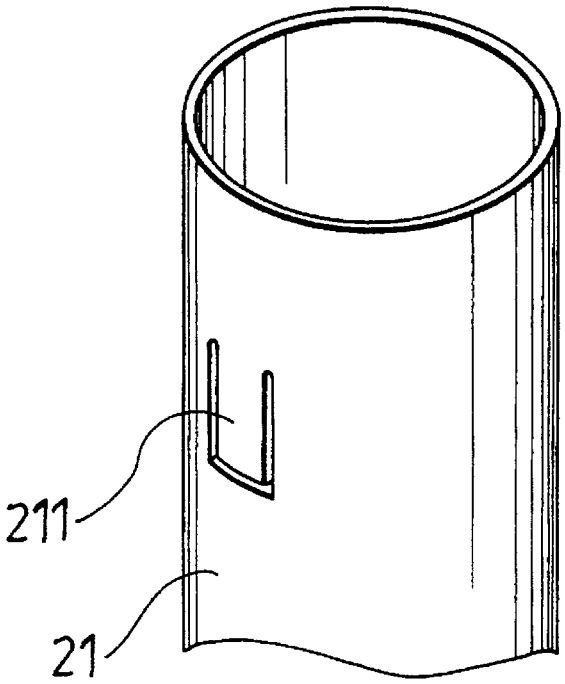
FIG.3(B) PRIOR ART

Note that in the suitcase body 40 of the present invention in comparison with the prior art of FIG. 2, does not need the L-shaped support plate to mount the roller assemblies 40. In order to simplify the structure of the wheeled suitcase of the present invention, the rotating shafts of the roller assembly are prevented from the movement by the long and short wires 31, 32 which are provided along the peripheral portion of the vertical side wall 301 of the suitcase body 30. In addition, the locking units have a simple structure to fasten the outer Lubes of the handle assembly 50 to the suitcase body 40.

With the present invention thus explained, it is obvious to those skilled in the art that various modifications and variations can be made without departing from the scope and spirit of the present invention. It is therefore intended that this invention be limited only as in the appended claims.

I claim:

1. A suitcase including a generally rectangular suitcase body with a vertical side wall and a horizontal bottom wall, two lower openings formed on the suitcase body and located at a corner between the side wall and the bottom wall of the suitcase body, two roller assemblies disposed on the suitcase body and inserted in the lower openings respectively, and a handle assembly disposed on the suitcase body, wherein the improvement comprises:

each of the roller assemblies including a roller seat mechanism which has an outer seat and an inner seat coupling with said outer seat fixed on the suitcase body and having a shaft hole unit formed through said roller seat mechanism, a rotating shaft extending through said shaft hole unit of said roller seat mechanism, a roller sleeved rotatably on said rotating shaft, said inner seat receiving said roller, said suitcase body further including a flexible long wire positioned on a peripheral portion of said vertical side wall of said suitcase body and having two end portions located between said bottom wall and said side wall of said suitcase body, and a horizontal short wire positioned between said bottom wall and said side wall of said suitcase body and between said two end portions of said long wire in alignment with said rotating shafts, each of said rotating shafts having two ends which respectively abut against an end of said short wire and an end of said long wire so as to prevent said rotating shafts from movement on said suitcase body.

2. A suitcase as claimed in claim 1, wherein said handle assembly includes two parallel vertical outer tubes secured in said suitcase body, and an inverted U-shaped inner tube that has two vertical sections mounted telescopically within upper end portions of said outer tubes, each of said roller seat mechanisms including a vertical positioning tube which is fixed in said suitcase body and which has a small-diameter upper portion and a large-diameter lower portion that has an outer diameter larger than that of said small-diameter upper portion so as to define a shoulder between said small-diameter upper portion and said large-diameter lower portion, each of said outer tubes of said handle assembly being sleeved on a corresponding one of said small-diameter upper portions of said positioning tubes and having an inner diameter smaller than outer diameter of said large-diameter lower portions of said positioning tubes so as to rest on a corresponding one of said shoulders of said positioning tubes, said suitcase further comprising two lock units which respectively lock the upper end portions of said outer tubes of said handle assembly on said suitcase body;

each of the upper end portions of said outer tubes of said handle assembly having two diametrically opposed holes formed through a wall thereof and a positioning notch formed in an upper end of said outer tube, said suitcase body having a horizontal top wall formed with two circular openings;

each of said lock units including a tubular bushing having a vertical cylindrical body which extends through one of said openings of said top wall of said suitcase body between a corresponding one of said outer tubes and a corresponding one of said vertical sections of said inner tube, and which has a protrusion extending from an outer surface of said cylindrical body to engage a corresponding one of said notches of said outer tubes, and two holes formed through a wall of said cylindrical body in alignment with said holes of a corresponding one of said outer tubes, and a flange extending radially and outwardly from an upper end of said cylindrical body and resting on a top surface of said horizontal top wall of said suitcase body so as to prevent said bushing from downward movement on said suitcase body; and a snap retainer made of a resilient material and having a vertical clamping wall of a generally C-shaped cross-section and a C-shaped flange extending outwardly from an upper end of said clamping wall to abut against a bottom surface of said top wall of said suitcase body, said clamping wall embracing a corresponding one of said outer tubes and having two aligned horizontal tongues extending inwardly from an inner surface of said clamping wall to insert within said holes of a corresponding one of said outer tubes and within said holes of a corresponding one of said bushings so as to retain said outer tubes on said suitcase body.

3. A suitcase as claimed in claim 2, wherein said handle assembly includes two peripherally toothed resilient positioning rings which are respectively secured to lower ends of said vertical sections of said inverted U-shaped inner tube within said outer tubes via two securing means respectively, each of said resilient positioning rings having an outer peripheral surface which contacts frictionally an inner surface of a corresponding one of said outer tubes and which is formed with a plurality of evenly distributed axial grooves which extend along total length thereof so as to position said vertical sections of said inner tube within said outer tubes.

* * * * *